US009022552B2

(12) United States Patent
Ishikawa et al.

(10) Patent No.: US 9,022,552 B2
(45) Date of Patent: May 5, 2015

(54) LIQUID EJECTING APPARATUS WITH A CONFIGURABLE SUPPORTING MEMBER

(71) Applicant: Seiko Epson Corporation, Tokyo (JP)

(72) Inventors: Akira Ishikawa, Shiojiri (JP); Kenichi Miyazaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 8 days.

(21) Appl. No.: 14/078,305

(22) Filed: Nov. 12, 2013

(65) Prior Publication Data

US 2014/0132691 A1 May 15, 2014

(30) Foreign Application Priority Data

Nov. 12, 2012 (JP) ..... 2012-248365

(51) Int. Cl.

| | |
|---|---|
| ***B41J 2/01*** | (2006.01) |
| ***B41J 11/00*** | (2006.01) |
| ***B41J 11/06*** | (2006.01) |
| ***B41J 15/04*** | (2006.01) |

(52) U.S. Cl.

CPC ..... *B41J 11/0085* (2013.01); *B41J 11/06* (2013.01); *B41J 15/04* (2013.01)

(58) Field of Classification Search

USPC ..... 347/8, 16, 104

See application file for complete search history.

(56) References Cited

FOREIGN PATENT DOCUMENTS

| | | | |
|---|---|---|---|
| JP | 2005-212425 | 8/2005 | |
| JP | 2005-212425 | * 11/2005 | ..... B41J 11/08 |
| JP | 2010-260342 | 11/2010 | |
| JP | 2011-046145 | 3/2011 | |

* cited by examiner

*Primary Examiner* — Henok Legesse
(74) *Attorney, Agent, or Firm* — Workman Nydegger

(57) ABSTRACT

A liquid ejecting apparatus, comprising: a liquid ejecting unit which ejects a liquid onto a medium that is transported in a transport direction; a suction mechanism for sucking the medium; a medium supporting portion in which two or more suction pores for applying a suction force of the suction mechanism to the medium are provided so as to be lined up in a width direction; and a supporting member which is configured separately from the medium supporting portion, which includes rib forming portions which form ribs that can support the medium, and which is disposed on the medium supporting portion such that the rib forming portions extend in the transport direction between two of the suction pores which are lined up in the width direction.

10 Claims, 5 Drawing Sheets

LIQUID EJECTING APPARATUS WITH A CONFIGURABLE SUPPORTING MEMBER

The entire disclosure of Japanese Patent Application No: 2012-248365, filed Nov. 12, 2013, is expressly incorporated by reference herein in its entirety.

BACKGROUND

1. Technical Field

The present invention relates to a liquid ejecting apparatus which ejects a liquid onto a medium which is caused to cling to a medium supporting portion.

2. Related Art

In the related art, an ink jet printer, which performs printing by ejecting an ink onto a medium (such as paper) that is transported on a medium supporting portion, is known as a liquid ejecting apparatus which is capable of ejecting a liquid. Directly after the paper is printed onto by such a printer, the paper may sometimes warps due to ink being absorbed therein, causing and swelling so as to form small waves in the paper. This phenomenon in which warping occurs due to swelling is also referred to as cockling. When the transport direction of the paper is the longitudinal direction of the paper, there are many cases in which unevenness occurs along the short direction (a width direction which intersects the transport direction) of the paper.

Furthermore, when the paper warps due to such cockling, there is a concern that the landing positions of the ink droplets will be scattered and the print quality will be reduced. Accordingly, a printer has been proposed in which ribs and concave portions are provided alternately on a medium supporting portion so as to be aligned across the width direction. The paper is sucked by providing suction pores in the inner bottom portion of the concave portions. Thus, the paper is caused to cling to the ribs, and the shifting of the landing positions of the ink droplets is suppressed (refer to JP-A-2005-212425).

However, since the intervals of the unevenness which occurs due to cockling change according to the material, the thickness and the like of the paper, it is preferable to change the pitch, the size and the like of the ribs, which are provided on the medium supporting portion, according to the paper. However, since the size of the ribs is small and it is necessary to dispose many ribs according to the positions of concave portions and suction pores, there is a problem in that a great amount of labor is incurred in order to form ribs of different pitches and sizes.

Furthermore, this problem is not limited to a printer which performs printing by ejecting an ink onto paper, and is generally common to all liquid ejecting apparatuses which eject a liquid onto a medium which clings to a medium supporting portion.

SUMMARY

An advantage of some aspects of embodiments described herein is to provide a liquid ejecting apparatus in which ribs can be easily formed, which ribs are provided on a medium supporting portion which causes a medium to cling thereto.

Hereinafter, the following means and the operations and effects thereof will be described.

According to an aspect of the invention, there is provided a liquid ejecting apparatus, which includes a liquid ejecting unit which ejects a liquid onto a medium that is transported in a transport direction; a suction mechanism for sucking the medium; a medium supporting portion, which has holding concave portion which extends in a width direction that intersects the transport direction, and in which two or more suction pores for applying a suction force of the suction mechanism to the medium are provided so as to be lined up in the width direction in an inner bottom portion of the holding concave portion; and a supporting member which is configured separately from the medium supporting portion, which includes rib forming portions which form ribs that can support the medium, and which is disposed within the holding concave portion of the medium supporting portion such that the rib forming portions extend in the transport direction between two of the suction pores which are lined up in the width direction.

In this configuration, it is possible to form the ribs which support the medium by disposing the supporting member, which is configured separately from the medium supporting portion and includes the rib forming portion, within the holding concave portion of the medium supporting portion while configuring the medium supporting portion to be of a simple shape which includes the suction pores within the holding concave portion. Accordingly, it is possible to easily form the ribs which are provided on the medium supporting portion which causes the medium to be adhered thereto.

In the liquid ejecting apparatus described above, two or more of the supporting members with a length in the width direction which is shorter than that of the medium supporting portion may be disposed within the holding concave portion of the medium supporting portion so as to be lined up in the width direction.

In this configuration, it is possible to form a plurality of the ribs within the holding concave portion by disposing two or more of the supporting members within the holding concave portion so as to be lined up in the width direction. In other words, it is possible to form a plurality of the ribs more easily by using a plurality of the supporting members which are shorter in the width direction than the medium supporting portion.

In the liquid ejecting apparatus described above, the supporting member may include a first rib forming portion and a second rib forming portion which are the rib forming portions that are lined up in the width direction, and a downstream side connecting portion which connects end portions of a downstream side in the transport direction of the first rib forming portion and the second rib forming portion, and an end portion of an upstream side in the transport direction of the downstream side connecting portion may extend in an inclined direction which intersects both the transport direction and the width direction.

In this configuration, since the downstream side connecting portion connects the end portions of the downstream side in the transport direction of the first rib forming portion and the second rib forming portion, the transported medium passes the downstream side connecting portion. At this time, the catching of the medium on the downstream side connecting portion is suppressed due to the medium being guided along the end portions of the upstream side in the transport direction of the downstream side connecting portion which extends in the inclined direction.

In the liquid ejecting apparatus described above, the supporting member may include two or more of the rib forming portions which are lined up in the width direction and a connecting portion which connects end portions in the transport direction of two of the rib forming portions which neighbor one another in the width direction, in which the rib forming portions and the connecting portion form an opening portion, and a suction concave portion for sucking the medium may be formed with the opening portion and an inner bottom portion of the holding concave portion due to the supporting member being accommodated within the holding concave portion such that the opening portion surrounds the suction pore.

In this configuration, is possible to form the suction concave portion by accommodating the supporting member in the holding concave portion. Accordingly, it is possible to easily form the suction concave portion for sucking the medium.

In the liquid ejecting apparatus described above, two or more of the opening portions may be provided in the supporting member so as to be lined up in the width direction.

In this configuration, is possible to form three of the ribs lined up in the width direction and two of the suction concave portions lined up in the width direction by accommodating one of the supporting members in the holding concave portion of the medium supporting portion.

In the liquid ejecting apparatus described above, the supporting member may be a plate-shaped member which includes a supporting surface which is shaped so as to be axially symmetrical, in which a straight line which extends in the width direction is an axis of symmetry.

In this configuration, since the supporting member is a plate-shaped member, the manufacturing is simple. In addition, it is possible to form the ribs even if the supporting member is disposed within the holding concave portion in a state of being inverted over the axis of symmetry. Accordingly, it is possible to easily perform the work of disposing the supporting member within the holding concave portion of the medium supporting portion.

The liquid ejecting apparatus described above may further include an adjustment mechanism which adjusts a relative position of the liquid ejecting unit in relation to the ribs, in which at least one of a plurality of the supporting members, which have different sizes of the rib forming portions, may be used for the supporting member.

In this configuration, it is possible to easily change the size of the ribs which are formed on the medium supporting portion by using other supporting members in which the sizes of the rib forming portions differ. In addition, even when the size of the ribs is changed, by adjusting the relative position of the liquid ejecting unit using the adjustment mechanism, it is possible to maintain an appropriate separation distance between the medium which is supported by the ribs and the liquid ejecting unit.

BRIEF DESCRIPTION OF THE DRAWINGS

The invention will be described with reference to the accompanying drawings, wherein like numbers reference like elements.

DESCRIPTION OF EXEMPLARY EMBODIMENT

Hereinafter, the embodiment of the liquid ejecting apparatus will be described with reference to the drawings.

Figure 1:
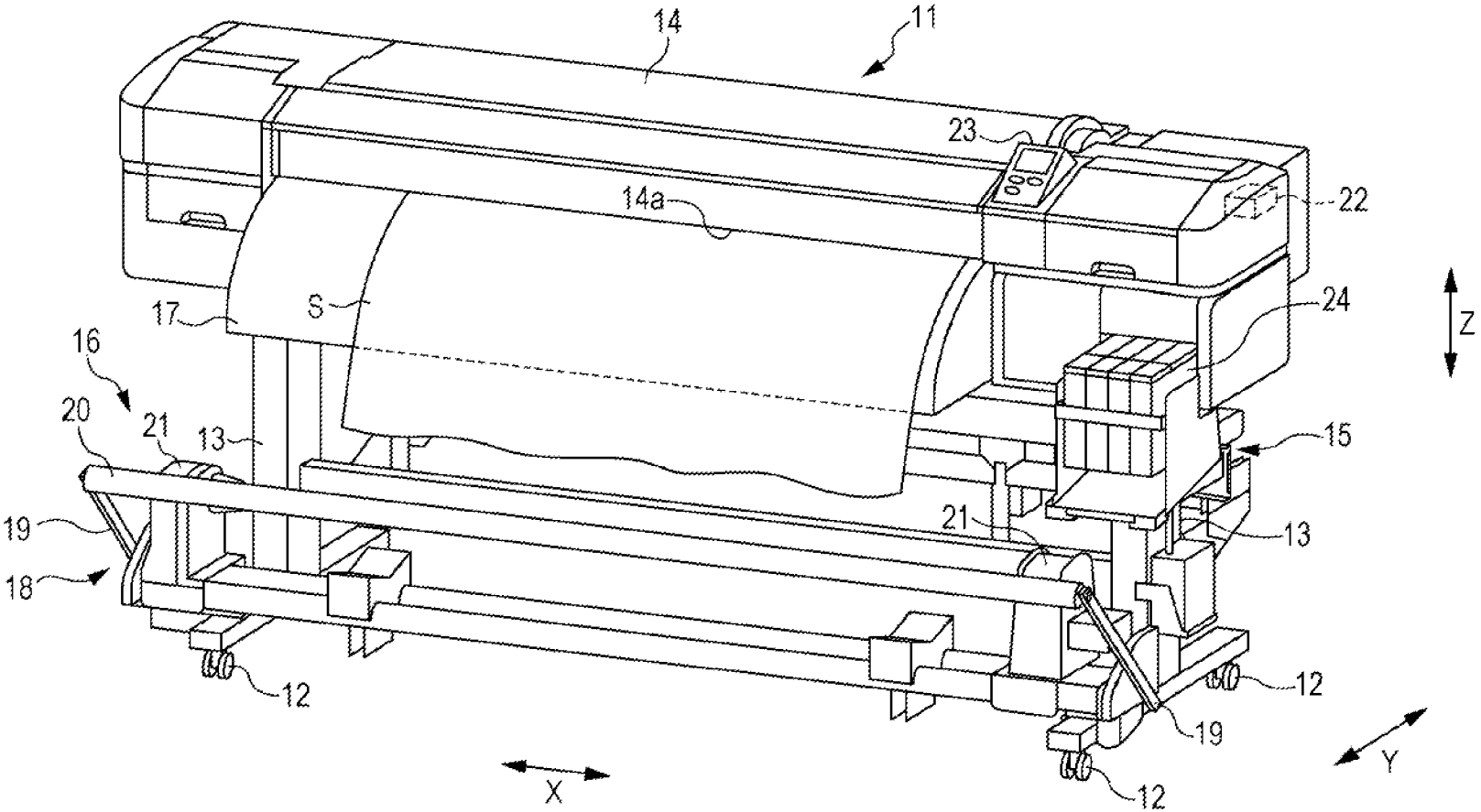
FIG. 1 is a perspective view of a liquid ejecting apparatus of an embodiment.

As shown in FIG. 1, the liquid ejecting apparatus 11 of the embodiment is a large format printer (LFP) which handles long paper S, which is an example of the medium. Furthermore, the liquid ejecting apparatus 11 includes a pair of leg portions 13 on the lower end of which wheels 12 are attached, and a housing portion 14 which is assembled on the leg portions 13. Furthermore, in the embodiment, the longitudinal direction of the housing portion 14 which intersects (in the embodiment, is perpendicular to) the vertical direction Z along the gravity direction, is the width direction X. In addition, a direction which intersects (in the embodiment, is perpendicular to) both the vertical direction Z and the width direction X is the front-back direction Y.

A feeding portion 15 which feeds the paper S toward the housing portion 14 side is disposed at the lower part of the rear side of the housing portion 14. The paper S of the embodiment is a roll of paper, and is a transfer medium (a transfer paper) for sublimation transfer textile printing. In such printing, a transfer image (a mirror image) is formed so as to leave margins at the margin boundaries in the width direction X (which is the short direction). The transfer image is for transfer onto a transfer-target medium (for example, a fabric such as polyester). In addition, the liquid ejecting apparatus 11 of the embodiment is an ink jet printer which forms a transfer image by ejecting a sublimation textile printing ink, which is an example of the liquid, onto the paper S.

A winding portion 16 which is supported by the leg portions 13 is disposed on the lower part of the front side of the housing portion 14. A medium guiding portion 17 is disposed along the transport path of the paper S between the feeding portion 15 and the winding portion 16.

The rear end side of the medium guiding portion 17 is accommodated within the housing portion 14, and the front end side of the medium guiding portion 17 protrudes forward from the housing portion 14. In addition, a discharge port 14*a* for discharging the paper S from within the housing portion 14 is formed on the front surface side of the housing portion 14 at a position which is the top side of the medium guiding portion 17.

A tension application mechanism 18 applies tension (tensile force) to the paper S which is positioned between the medium guiding portion 17 and the winding portion 16, and is provided in a position close to the winding portion 16. The tension application mechanism 18 is provided with a pair of arm members 19 supported rotatably on the lower portion of the leg portions 13, and a tension roller 20 supported rotatably on the front end portion of the pair of arm members 19. In addition, the winding portion 16 is provided with a pair of holders 21 which pinch a core (for example, a paper tube, not shown), onto which the printed paper S is wound from both axial directions in a cylinder shape.

A control unit 22 controls the operations of the liquid ejecting apparatus 11 and is provided within the housing portion 14. In addition, an operation panel 23 (for performing setting operations, input operations and the like) is provided on the upper portion of the housing portion 14 on a first end side (the right end side in FIG. 1) of the width direction X. Furthermore, the operation panel 23 is electrically connected to the control unit 22.

A liquid holding container 24 (which can hold ink) is provided on the lower portion of the housing portion 14 on the first end side (the right end side in FIG. 1) of the width direction X, which is the outside of the transport path of the paper S. A plurality of (four in the embodiment) the liquid holding containers 24 are provided corresponding to the types and colors of the ink.

Figure 2:
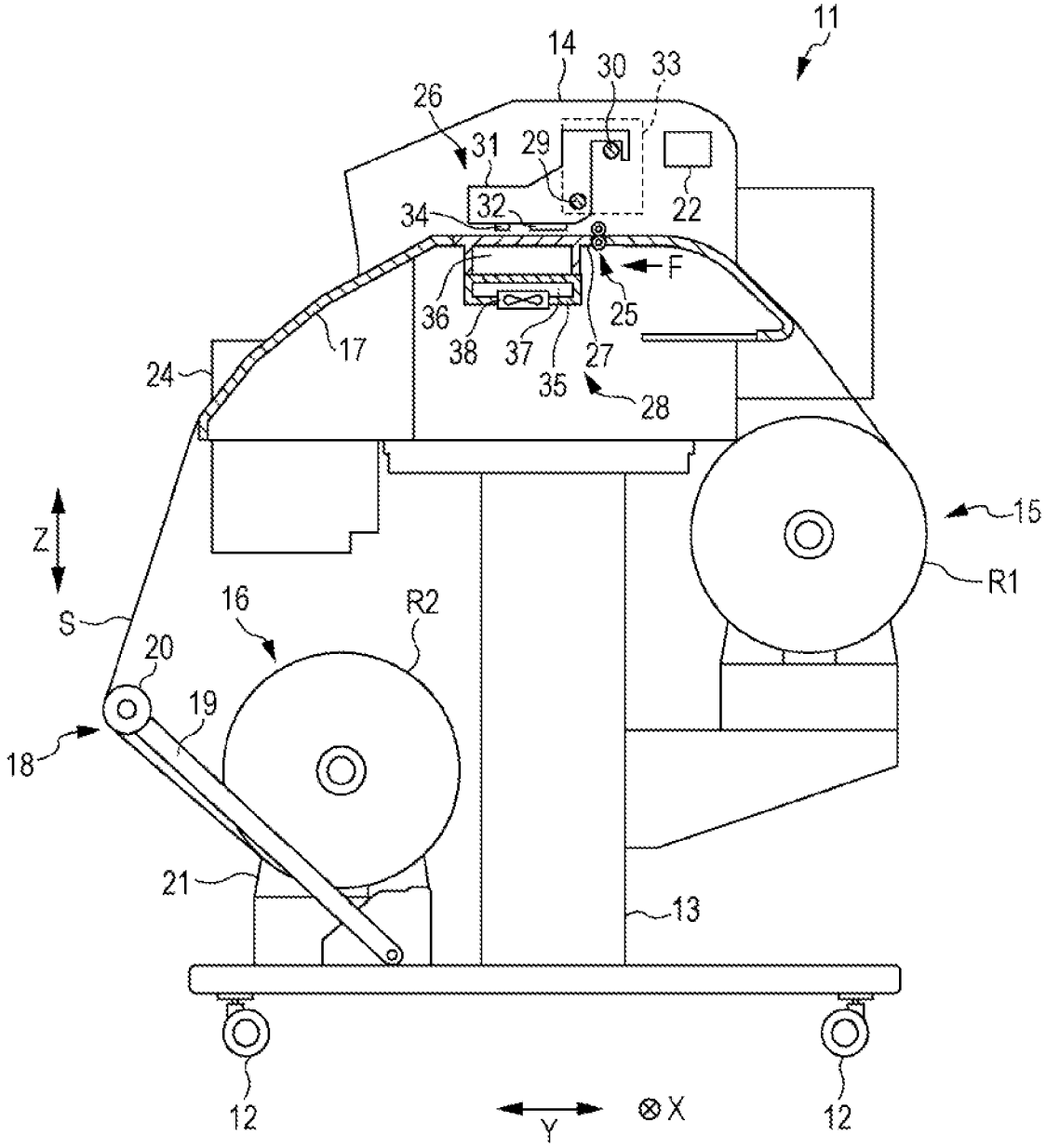
FIG. 2 is a cross-sectional view showing the schematic configuration of the liquid ejecting apparatus.

As shown in FIG. 2, a roll body R1 (around which the unused paper S is wound in a cylinder shape) is maintained in the feeding portion 15. Furthermore, a plurality of sizes of the roll body R1 with different widths (the length in the width direction X, which is the short direction) and different winding numbers of the paper S are mountable into the feeding portion 15 in an exchangeable manner. Furthermore, regardless of the size of the roll body R1, the roll body R1 is mounted into the feeding portion 15 in a state of being close to the first end side (the right end side in FIG. 1) of the width direction X. In other words, in the embodiment, the alignment reference position of the paper S is set to the first end side of the width direction X. Furthermore, the feeding portion 15 causes the roll body R1 to rotate in the anticlockwise direction in FIG. 2. Therefore, the paper S is unwound from the roll body R1 and fed to the inside of the housing portion 14.

A transport roller pair 25 (which transports the paper S), a recording unit 26 (which performs printing (recording) on the paper S which is transported in the transport direction F by the transport roller pair 25), a medium supporting portion 27 (which supports the paper S), and a suction mechanism 28 (for sucking the paper S) are accommodated within the housing portion 14.

Guide shafts 29 and 30 (which are installed so as to extend in the width direction X), a carriage 31 (which is supported by the guide shafts 29 and 30), and a liquid ejecting unit 32 (which is maintained on the lower portion of the carriage 31) are provided in the recording unit 26. Furthermore, the carriage 31 moves reciprocally along the guide shafts 29 and 30 within a movement region which extends in the main scanning direction (the width direction X in the embodiment) which is perpendicular to the transport direction F of the paper S.

An adjustment mechanism 33 changes the height (the position in the vertical direction Z) of the liquid ejecting unit 32 in order to adjust the separation distance between the liquid ejecting unit 32 and the paper S, and is provided on both end portions in the width direction X of the guide shafts 29 and 30. In addition, a reflection sensor 34 (which is an example of a paper width sensor) is maintained on a lower portion of the carriage 31 in a position that is closer to the downstream side of the transport direction than the liquid ejecting unit 32.

The reflection sensor 34 is an optical sensor which includes a light source portion and a light reception portion (neither of which is shown). In addition, in the reflection sensor 34, the light receiving portion receives the reflected light of the light emitted downward from the light source portion, and a detected value V (a voltage value) which corresponds to the strength of the reflected light received by the light receiving portion is output to the control unit 22. In addition, the width (the length in the width direction X) of the paper S is calculated by 1) performing detection using the reflection sensor 34 while causing the carriage 31 to move in the main scanning direction, and then, 2) the control unit 22 detecting the position at which the reflection target changes based on the detected value V, that is, the position of both end portions in the width direction X of the paper S.

Furthermore, the recording (the printing) is performed by the liquid ejecting unit 32 ejecting the ink which is supplied from the liquid holding container 24 onto the paper S which is transported along the transport path according to the width of the paper S which is detected. In addition, the printed paper S is guided downwardly sloped along the medium guiding portion 17, and subsequently, is wound around the winding portion 16 to form the roll body R2. At this time, a tensile force is applied to the paper S, which is wound around the winding portion 16, due to the tension roller 20 pressing the rear surface side of the paper S which hangs down from the medium guiding portion 17 due to its own weight.

Furthermore, in the liquid ejecting apparatus 11 of the embodiment, the paper S can also be discharged without being wound around the roll body R2. For example, the post-printed paper S can be held in an installed discharge basket (not shown) instead of the winding portion 16.

Figure 3:
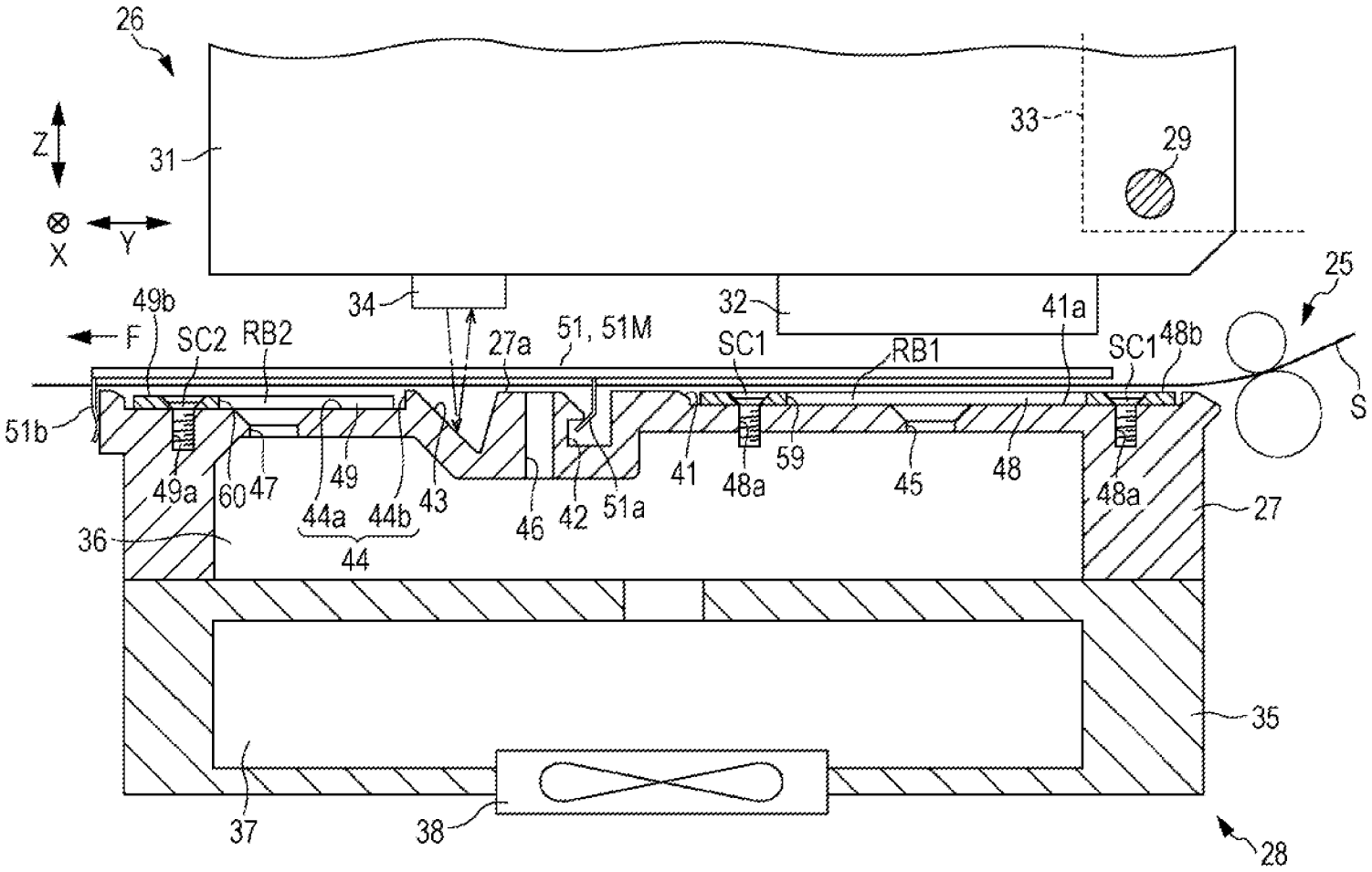
FIG. 3 is a cross-sectional view showing the schematic configuration of a medium supporting portion and a suction mechanism.

As shown in FIG. 3, the medium supporting portion 27 is a bottomed box shape, and is fixed to the lower part of the movement region of the carriage 31 such that the bottom portion of the medium supporting portion 27 is disposed on the upper side. In addition, a box-shaped suction chamber forming member 35 is assembled on the lower portion of the medium supporting portion 27. Furthermore, a negative pressure chamber 36 is formed by the medium supporting portion 27 and the suction chamber forming member 35.

The suction chamber forming member 35 forms a suction chamber 37, which communicates with the negative pressure chamber 36. In addition, an exhaust fan 38 (for discharging the air within the suction chamber 37 to the outside) is installed in the suction chamber forming member 35. Furthermore, the suction chamber forming member 35 and the exhaust fan 38 form the suction mechanism 28.

A first holding concave portion 41, which is an example of the holding concave portion, a locking concave portion 42, a reflecting groove portion 43 and a second holding concave portion 44, which is an example of the holding concave portion, are provided on the upper surface side of the medium supporting portion 27 so as to extend in the width direction X lined up in order from the upstream side of the transport direction F.

The first holding concave portion 41 is disposed in a position opposing the liquid ejecting unit 32 which moves together with the carriage 31. Furthermore, the length in the transport direction F of the first holding concave portion 41 is longer than that of the second holding concave portion 44. In addition, the reflecting groove portion 43 is disposed in a position opposing the reflection sensor 34 which moves together with the carriage 31.

Reflecting the light output from the reflection sensor 34 using the reflecting groove portion 43 results in a greater reflection distance than reflecting the light using an upper end surface 27*a* of the medium supporting portion 27. In addition, in the liquid ejecting apparatus 11, white paper with a high reflectance is often used as the paper S. Therefore, by setting the reflecting groove portion 43 to be the reflection target of the light output from the reflection sensor 34, the reflectance of the light is clearly lower than the reflectance of the paper S and the detection precision improves. Furthermore, by performing the printing process according to the calculated width of the paper S, the ink is not adhered to the medium supporting portion 27 and the paper S being transported is no longer polluted.

Suction pores 45, 46 and 47 which communicate with the negative pressure chamber 36 are formed in the medium supporting portion 27 so as to be lined up in order from the upstream side of the transport direction F. Furthermore, the suction pore 45 is disposed on an inner bottom portion 41*a* of the first holding concave portion 41. In addition, the suction pore 46 is disposed in a position between the locking concave portion 42 and the reflecting groove portion 43 in the transport direction F, so as to be open to the upper end surface 27*a* of the medium supporting portion 27. Furthermore, the suction pore 47 is disposed on an inner bottom portion 44*a* of the second holding concave portion 44.

A first supporting member 48, which is a plate-shaped supporting member, is disposed within the first holding concave portion 41 of the medium supporting portion 27 and is configured separately from the medium supporting portion 27. In addition, a second supporting member 49, which is a plate-shaped supporting member, is disposed within the second holding concave portion 44 of the medium supporting portion 27 and is configured separately from the medium supporting portion 27 and the first supporting member 48. Furthermore, the length in the transport direction F of the first supporting member 48 is longer than that of the second supporting member 49.

A pair of medium restraint members 51 are installed on both end sides in the width direction X of the medium supporting portion 27. Furthermore, in FIG. 3, only one medium restraint member 51M is shown. The medium restraint members 51 include locking tabs 51*a* and 51*b*. Furthermore, the locking tab 51*a* of the medium restraint members 51 is locked into the locking concave portion 42 of the medium supporting portion 27. Meanwhile, the locking tab 51*b* is locked to the end portion of the downstream side of the transport direction of the medium supporting portion 27.

Figure 4:
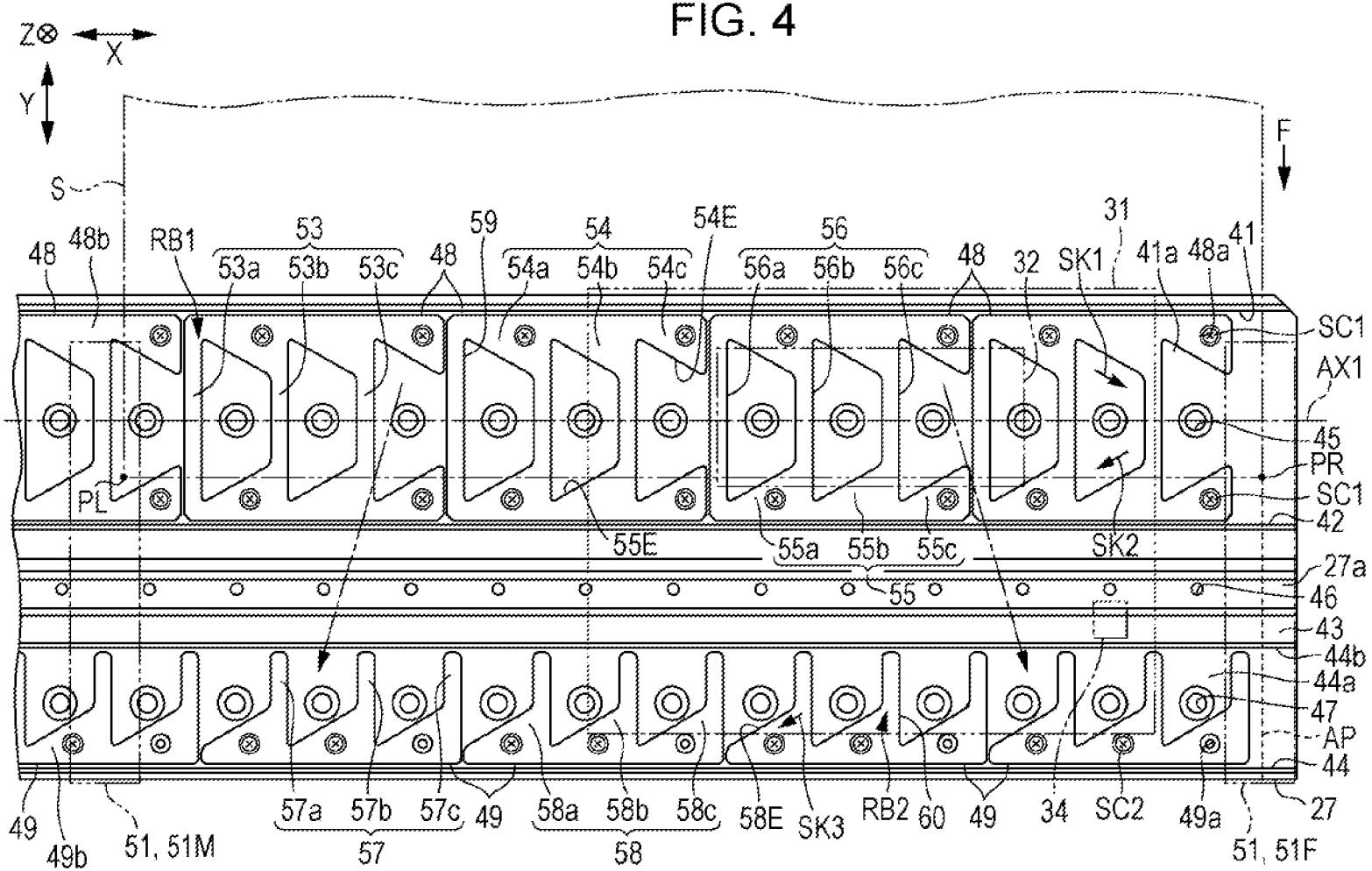
FIG. 4 is a top view of the medium supporting portion on which supporting members are disposed.

As shown in FIG. 4, of the medium restraint members 51 which form a pair, the medium restraint member 51M is movable in the width direction X along the locking concave portion 42. In addition, another medium restraint member 51F is fixed so as to overlap an alignment reference position AP which is set to the first end side (the right end side in FIGS. 1 and 4) in the width direction X of the medium supporting portion 27.

Furthermore, there is a case in which the paper S with a different length in the width direction X (a width) is transported on the medium supporting portion 27. However, in either case, the paper S is transported in a state in which the end portion of the first end side (the right end side in FIG. 4) of the width direction X is aligned with the alignment reference position AP. Furthermore, in the paper S which is transported, the end portion of the first end side in the width direction X is disposed between the medium supporting portion 27 and the medium restraint member 51F in the vertical direction Z.

In addition, by moving the medium restraint member 51M in the width direction X, the end portion of the second end side (the left end side in FIG. 4) in the width direction X of the paper S is disposed between the medium supporting portion 27 and the medium restraint member 51M in the vertical direction Z. Furthermore, it is preferable that the medium restraint members 51 be disposed so as to overlap the margin portions at which the printing of the paper S is not performed.

A plurality of (four in the embodiment) screw holes 48*a* are formed in the first supporting member 48 which is accommodated within the first holding concave portion 41 of the medium supporting portion 27. Furthermore, the four screw holes 48*a* are disposed in positions corresponding to the four corners of the first supporting member 48 to form a substantially rectangular shape when seen in plan view. Furthermore, the first supporting member 48 is screwed into the medium supporting portion 27 using screws SC1 which are inserted through the screw holes 48*a*.

A plurality of (three in the embodiment) screw holes 49*a* are formed so as to be lined up in the width direction X in the second supporting member 49 which is accommodated within the second holding concave portion 44 of the medium supporting portion 27. Furthermore, the second supporting member 49 is screwed into the medium supporting portion 27 using screws SC2 which are inserted through two of the three screw holes 49*a*.

Two or more (a plurality) of the suction pores 45 are provided in the inner bottom portion 41*a* of the first holding concave portion 41 in the medium supporting portion 27 so as to be lined up in the width direction X at a predetermined interval. In addition, two or more (a plurality) of the first supporting members 48 are disposed within the first holding concave portion 41 so as to be lined up in the width direction X. The first supporting member 48 is a plate-shaped member with a length in the width direction X which is shorter than that of the medium supporting portion 27. Furthermore, the first supporting member 48 includes a supporting surface 48*b* of an axially symmetrical shape in which a straight line, which passes through the center of the opening of the suction pore 45 and extends in the width direction X, is an axis of symmetry AX1.

The first supporting member 48 includes a first rib forming portion 53*a*, a second rib forming portion 53*b* and a third rib forming portion 53*c*, which are three rib forming portions 53 which form ribs RB1 which can support the paper S. Furthermore, the three rib forming portions 53 are disposed so as to be lined up in the width direction X in the medium supporting portion 27.

In addition, the first supporting member 48 includes connecting portions 54 (54*a*, 54*b* and 54*c*) and 55 (55*a*, 55*b* and 55*c*) which connect the end portions of two of the rib forming portions 53 in the transport direction F, where the two rib forming portions 53 neighbor each other in the width direction X. In other words, the first supporting member 48 includes the first upstream side connecting portion 54*a*, the second upstream side connecting portion 54*b* and the third upstream side connecting portion 54*c*.

The first upstream side connecting portion 54*a* connects the end portions of the upstream side in the transport direction F of the first rib forming portion 53*a* and the second rib forming portion 53*b*. The second upstream side connecting portion 54*b* connects the end portions of the upstream side in the transport direction F of the second rib forming portion 53*b* and the third rib forming portion 53*c*.

In addition, the first supporting member 48 includes the first downstream side connecting portion 55*a*, the second downstream side connecting portion 55*b* and the third downstream side connecting portion 55*c*. The first downstream side connecting portion 55*a* connects the end portions of the downstream side in the transport direction F of the first rib forming portion 53*a* and the second rib forming portion 53*b*. The second downstream side connecting portion 55*b* connects the end portions of the downstream side in the transport direction F of the second rib forming portion 53*b* and the third rib forming portion 53*c*.

The rib forming portions 53 and the connecting portions 54 and 55 of the first supporting member 48 form a plurality of opening portions 56 (56*a*, 56*b* and 56*c*) which are lined up in the width direction X. In other words, the first rib forming portion 53*a*, the second rib forming portion 53*b*, the first upstream side connecting portion 54*a* and the first downstream side connecting portion 55*a* form the opening portion 56*a*. In addition, the second rib forming portion 53*b*, the third rib forming portion 53*c*, the second upstream side connecting portion 54*b* and the second downstream side connecting portion 55*b* form the opening portion 56*b*.

When the third upstream side connecting portion 54*c* and the third downstream side connecting portion 55*c* of the first supporting member 48 are disposed so as to neighbor another of the first supporting members 48 on one side (the right side in FIG. 4) in the width direction X, by lining up with the first rib forming portion 53*a* which is formed on the other one of the first supporting member 48, the third upstream side connecting portion 54*c* and the third downstream side connecting portion 55*c* form the opening portion 56*c* together with the third rib forming portion 53*c*.

An end portion 54E of the downstream side in the transport direction F of the upstream side connecting portions 54 (which connect the end portions of the upstream side in the transport direction of the rib forming portions 53) extends in an inclined direction SK1 which intersects both the transport direction F and the width direction X.

In addition, an end portion 55E of the upstream side in the transport direction F of the downstream side connecting portions 55 (which connect the end portions of the downstream side in the transport direction of the rib forming portions 53) extends in an inclined direction SK2 which intersects both the transport direction F and the width direction X. Furthermore, the end portion 55E and the end portion 54E are shaped so as to be axially symmetrical in relation to the axis of symmetry AX1. Therefore, the inclined direction SK2 of the end portion 55E is a direction which intersects the inclined direction SK1 of the end portion 54E.

Therefore, in the rib forming portion 53 which forms the opening portion 56, one end side (the right end side in FIG. 4) of the rib forming portion 53 (which is positioned on another side (the left side in FIG. 4) of the opening portion 56 in the width direction X) extends further to the downstream side in the transport direction F than another end side (the left end side in FIG. 4) of the rib forming portion 53 (which is positioned on one side (the right side in FIG. 4) of the opening portions 56 in the width direction X).

Meanwhile, two or more (a plurality) of the suction pores 47 are provided in the inner bottom portion 44*a* of the second holding concave portion 44 in the medium supporting portion 27 so as to be lined up in the width direction X at a predetermined interval. In addition, two or more (a plurality) of the second supporting members 49 are disposed within the second holding concave portion 44 so as to be lined up in the width direction X. The second supporting member 49 is a plate-shaped member which includes a supporting surface 49*b* and has a length in the width direction X which is shorter than that of the medium supporting portion 27. Furthermore, the lengths in the width direction X of the first supporting member 48 and the second supporting member 49 are approximately the same.

The second supporting member 49 includes a first rib forming portion 57*a*, a second rib forming portion 57*b* and a third rib forming portion 57*c*, which are three rib forming portions 57 which form ribs RB2 which can support the paper S. Furthermore, the three rib forming portions 57 are disposed so as to be lined up in the width direction X in the second supporting member 49. In addition, the end portion of the upstream side in the transport direction of the rib forming portions 57 extends close to an inside wall 44*b* of the upstream side in the transport direction of the second holding concave portion 44.

The second supporting member 49 includes a first downstream side connecting portion 58*a*, a second downstream side connecting portion 58*b* and a third downstream side connecting portion 58*c*, which are downstream side connecting portions 58 which connect the end portions of the downstream side of two of the rib forming portions 57 in the transport direction F, where the two rib forming portions 57 neighbor each other in the width direction X. The second downstream side connecting portion 58*b* connects the end portions of the downstream side in the transport direction F of the first rib forming portion 57*a* and the second rib forming portion 57*b*. In addition, the third downstream side connecting portion 58*c* connects the end portions of the downstream side in the transport direction F of the second rib forming portion 57*b* and the third rib forming portion 57*c*.

In the first supporting member 48, the rib forming portions 53 are disposed within the first holding concave portion 41 so as to extend in the transport direction F between two of the suction pores 45 which are lined up in the width direction X. In addition, due to the opening portions 56 being accommodated within the first holding concave portion 41 so as to surround the suction pore 45, using the opening portions 56 and the inner bottom portion 41*a* of the first holding concave portion 41, the first supporting member 48 forms a first suction concave portion 59 for sucking the paper S.

Meanwhile, in the second supporting member 49, the rib forming portions 57 are disposed within the second holding concave portion 44 so as to extend in the transport direction F between two of the suction pores 47 which are lined up in the width direction X. In addition, due to the rib forming portions 57 and the downstream side connecting portions 58 being accommodated within the second holding concave portion 44 so as to surround the suction pore 47, the second supporting member 49 forms a second suction concave portion 60 for sucking the paper S.

Furthermore, two of the second supporting members 49 which are lined up in the width direction X form the second suction concave portion 60 by the suction pore 47 being surrounded by the first rib forming portion 57*a* and the first downstream side connecting portion 58*a* of the second supporting member 49 which is positioned on one side (the right side in FIG. 1) of the width direction X, and the third rib forming portion 57*c* of the second supporting member 49 which is positioned on the other side (the left side in FIG. 1) of the width direction X.

An end portion 58E of the upstream side in the transport direction F of the downstream side connecting portions 58 which connect the end portions of the downstream side in the transport direction of the rib forming portions 57 extends in an inclined direction SK3 which intersects both the transport direction F and the width direction X. Furthermore, the inclined direction SK3 of the end portion 58E is a direction which is parallel to the inclined direction SK2 of the end portion 55E, and is a direction which intersects the inclined direction SK1 of the end portion 54E. Furthermore, the inclined directions SK2 and SK3 separate from the alignment reference position AP of the paper S from the upstream side in the transport direction F toward the downstream side.

Therefore, in the rib forming portion 57 which forms the second suction concave portion 60, one end side (the right end side in FIG. 4) of the rib forming portion 57 of the other side (the left side in FIG. 4) of the second suction concave portion 60 in the width direction X extends further to the downstream side in the transport direction F than the other end side (the left end side in FIG. 4) of the rib forming portions 57 of one side (the right side in FIG. 4) of second suction concave portion 60 in the width direction X.

In the first supporting member 48 and the second supporting member 49, which are disposed furthest to the first end side (the right end side in FIG. 4) in the width direction X, the end portions of the first end side in the width direction X are disposed in a position so as to overlap the medium restraint member 51F in the vertical direction Z. In addition, the position is closer to the second end side (the left end side in FIG. 4) in the width direction X than the alignment reference position AP. In addition, the first supporting member 48 and the second supporting member 49 are set to be disposed in the width direction X such that the ribs RB1 and the ribs RB2 are lined up in the transport direction F.

Furthermore, in the first supporting member 48, the screw holes 48*a* are formed in the connecting portions 54 (54*a* and 54*c*) and 55 (55*a* and 55*c*). In addition, in the second supporting member 49, the screw holes 49*a* are formed in the connecting portions 58 (58*a*, 58*b* and 58*c*), and the screws SC2 are inserted through the screw holes 49*a* which are formed in the first downstream side connecting portion 58*a* and the second downstream side connecting portion 58*b*.

Next, description will be given of the actions of the liquid ejecting apparatus 11, which is configured as described above.

Figure 5:
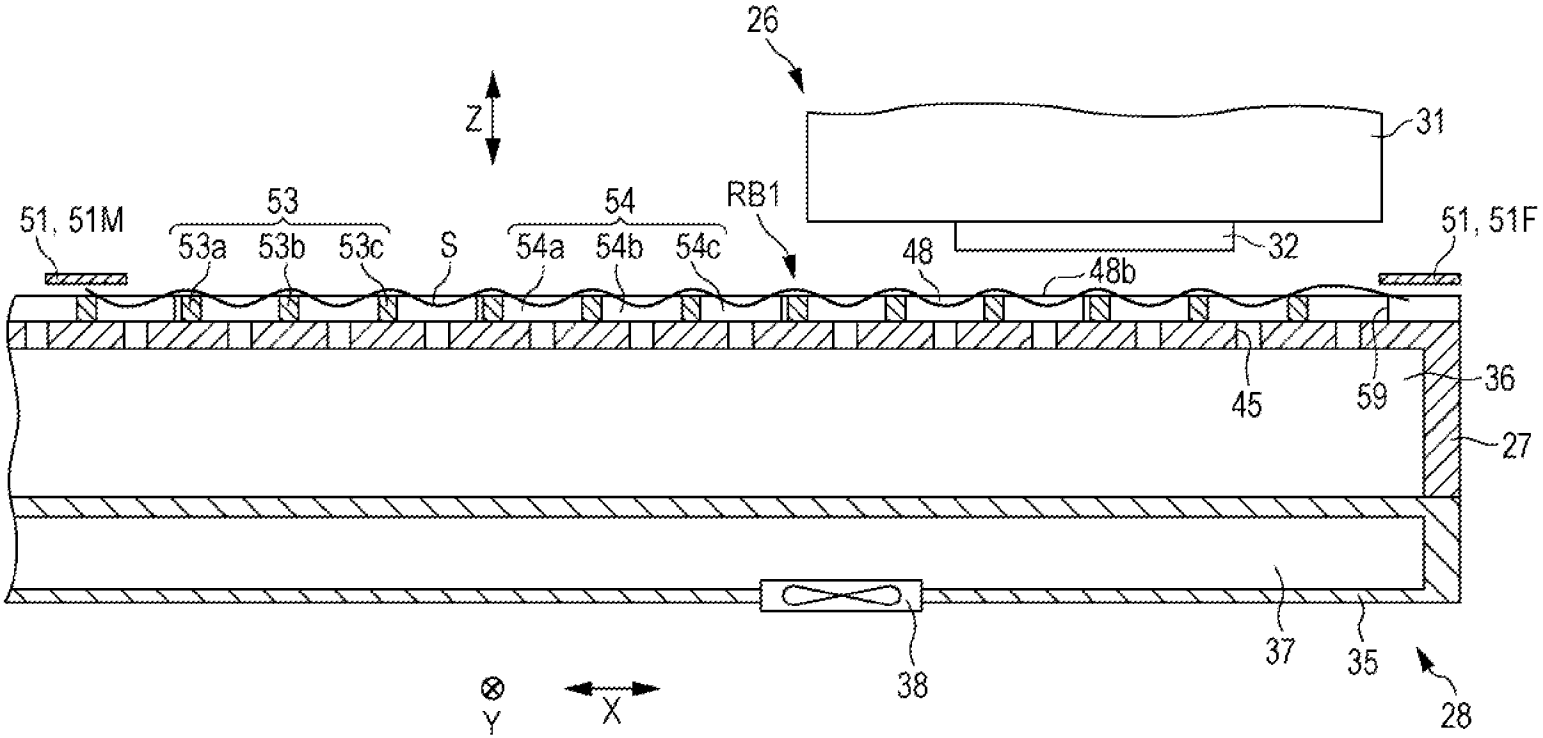
FIG. 5 is a cross-sectional view for illustrating the effects of the medium supporting portion and the suction mechanism.

As shown in FIG. 5, when the liquid ejecting unit 32 ejects the ink onto the paper S, the exhaust fan 38 rotates. Furthermore, in the medium supporting portion 27, the suction pore 45 communicates with the inside of the first suction concave portion 59 which is formed by the medium supporting portion 27 and the first supporting member 48.

Therefore, when the suction chamber 37 and the negative pressure chamber 36 enter a negative pressure state due to the rotation of the exhaust fan 38, the negative pressure is also applied to the inside of the first suction concave portion 59, the opening of which is covered by the paper S. Therefore, the paper S is adhered to the supporting surface 48*b* of the first supporting member 48 in a state of being slightly warped so as to form waves in the width direction X, by being sucked by the inside of the first suction concave portion 59 in a state of being supported by the ribs RB1.

Furthermore, a winding curl (which the paper S is subjected to due to being wound into a cylindrical shape and causes the paper S to bend in the longitudinal direction) is corrected by warping the paper S regularly in the width direction X along the disposition of the first suction concave portion 59 using the suction force of the suction mechanism 28.

Furthermore, when the paper S lifts up from the medium supporting portion 27 due to the winding curl, there is a concern that the landing position of the ink will shift due to the separation distance between the paper S and the liquid ejecting unit 32 fluctuating, and that the printing quality will be reduced. This concern is addressed in the embodiment by the fluctuation of the separation distance between the paper S and the liquid ejecting unit 32 being suppressed by the paper S being caused to cling to the medium supporting portion 27 and the first supporting member 48.

Here, since the paper S is transfer paper, it is necessary for the paper S to accept a sufficient amount of the ink to perform textile printing on a transfer-target medium such as a fabric, and the degree of warping due to swelling is greater than that of normal paper. Furthermore, when the printed portion of the paper S swells, as shown by the arrow of the single dotted chain line in FIG. 4, unevenness of the paper S spreads out toward the end portion sides in the width direction X, and there is a case in which the warping close to the end portions combines to cause the paper S to lift up even further. Furthermore, when the warping of the paper S increases, there is a concern that the influence thereof will also affect the upstream side in the transport direction, and that the landing position of the ink will be shifted.

In addition, in bordered printing in which margins remain at the end portions of the width direction X, since the warping at the end portions may not be released, there is a tendency for the end portion sides of the width direction X to lift up due to swelling. Incidentally, even when using borderless printing in which margins do not remain at the end portions of the width direction X, when the amount of the ink which is ejected onto the end portion side of the paper S in the width direction X is little, or the like, there is a case in which the end portion sides of the width direction X lift up. Furthermore, when the paper S lifts up from the medium supporting portion 27 in a state in which the warping is combined, there is a concern that the printing surface will make contact with the liquid ejecting unit 32, the carriage 31 and the like.

Furthermore, since the paper S is transfer paper, in order to transfer the ink (the transfer image) onto the transfer-target medium, there is a case in which the paper S is subjected to a coating so that the ink does not seep through to the rear surface side. Therefore, the paper S is characterized in that the accepted ink does not dry easily in comparison with normal paper such as copier paper which becomes a complete product due to an image being formed by the reception of the ink. Furthermore, when the printing surface makes contact with the liquid ejecting unit 32 or the like in a state in which the ink is not yet dry, the ink at the contacted portion is removed and the quality is reduced due to a portion of the image transferred onto the transfer-target medium being absent.

Accordingly, in the embodiment, as shown in FIG. 4, since the medium restraint members 51 are disposed in positions which overlap with the end portions of the paper S in the width direction X, the lifting up of the paper S at the end portions in the width direction X is suppressed. In addition, by sucking the paper S which accepts the ink, the suction pores 46 and 47, which are disposed further on the downstream side in the transport direction than the liquid ejecting unit 32, suppress the lifting up of the paper S.

In other words, as shown in FIG. 3, the suction pore 47 communicates with the inside of the second suction concave portion 60 which is formed by the medium supporting portion 27 and the second supporting member 49. Therefore, when the suction chamber 37 and the negative pressure chamber 36 enter a negative pressure state due to the rotation of the exhaust fan 38, the negative pressure is also applied to the inside of the second suction concave portion 60, the opening of which is covered by the paper S. Therefore, the paper S is adhered to the upper end surface 27*a* of the medium supporting portion 27 and the supporting surface 49*b* of the second supporting member 49 by being sucked by the inside of the second suction concave portion 60 in a state of being supported by the ribs RB2.

Furthermore, even when it is not possible to prevent the warping caused by the swelling of the paper S using such adhesion, by suppressing the combination of the warping close to the end portions of the width direction X, it is possible to suppress the lifting up of the paper S and to prevent the printing surface from being damaged.

As shown in FIG. 4, in the embodiment, the ribs RB1 and RB2 which support the paper S are formed by disposing the supporting members 48 and 49, which are configured separately from the medium supporting portion 27, within the holding concave portions 41 and 44 of the medium supporting portion 27. Furthermore, the first supporting member 48 which is accommodated within the first holding concave portion 41, which is positioned to oppose the liquid ejecting unit 32, is screwed in at positions corresponding to the four corners. Therefore, the lifting up from the inner bottom portion 41*a* is suppressed. In addition, since the first suction concave portion 59 is formed by the opening portion 56 which is formed in the first supporting member 48, the negative pressure within the first suction concave portion 59 is maintained and it is possible to suck the paper S with a stronger force.

Meanwhile, in the second supporting member 49, a part of the downstream side of the transport direction F is screwed into the medium supporting portion 27. In addition, the second supporting member 49 does not include an upstream side connecting portion which connects the end portions of the upstream side in the transport direction of the rib forming portions 57, and forms the second suction concave portion 60 using the rib forming portions 57, the downstream side connecting portions 58 and the inside wall 44*b* of the second holding concave portion 44. In other words, since the second supporting member 49 is accommodated in the second holding concave portion 44, the length in the transport direction F of which is shorter than that of the first suction concave portion 59, the configuration of the second supporting member 49 is simpler than that of the first supporting member 48.

Furthermore, as shown in FIG. 3, the screw holes 48*a* and 49*a* are formed in a size such that the head portions of the screws SC1 and SC2 do not protrude from the supporting surfaces 48*b* and 49*b*. Therefore, even if the screws SC1 and SC2 are used in order to fix the supporting members 48 and 49, the catching of the front end of the paper S on the screws SC1 and SC2 is suppressed.

In addition, as shown in FIG. 4, since the end portions 55E and 58E of the downstream side connecting portions 55 and 58 (which are formed on the supporting members 48 and 49) extend in the inclined directions SK2 and SK3, the front end of the paper S proceeds in the transport direction while being guided by the incline of the end portions 55E and 58E. At this time, when a corner PL, which is formed by the front end in the transport direction F of the paper S and the second end (the left end in FIG. 4) in the width direction X of the paper S, catches on the end portions 55E and 58E, there is a concern that problems will occur when transporting the paper S.

Since the inclined directions SK2 and SK3 separate from the alignment reference position AP of the paper S from the upstream side in the transport direction F toward the downstream side, the corner PL of the paper S is guided toward the outside (the left side in FIG. 4) in the width direction X by the end portions 55E and 58E. In addition, a corner PR, which is formed by the front end in the transport direction F of the paper S and the first end (the right end in FIG. 4) in the width direction X, is disposed closer to the outside (the right side in FIG. 4) than the end portions 55E and 58E. Therefore, problems transporting the paper S due to the corners PL and PR of the paper S catching on the end portions 55E and 58E do not occur easily.

Furthermore, when the alignment reference position AP is set to a position which intersects the end portions 55E and 58E, the incline angle of the end portions 55E and 58E which intersect the alignment reference position AP may be changed. For example, by disposing the supporting members 48 and 49, which are positioned so as to overlap the alignment reference position AP, inverted over the axis of symmetry which extends in the transport direction F, a mode is realized in which the end portions 55E and 58E, which guide the corner PR of the paper S, extend in a direction parallel to the inclined direction SK1. In this case, since the corners PL and PR of the paper S are respectively guided toward the outside in the width direction X, it is possible to suppress an occurrence of problems in transporting, to flatten out wrinkles in the paper S, and to suppress skewing of the paper S.

Furthermore, in the embodiment, the three ribs RB1 and RB2 and the two suction concave portions 59 and 60 are formed by disposing one of the supporting members 48 and 49 in each of the holding concave portions 41 and 44. In addition, by lining up the supporting members 48 and 49 such that they neighbor one another in the width direction X, a multiplicity of the ribs RB1 and RB2 and the suction concave portions 59 and 60 are formed across the entire width in the width direction X.

Furthermore, by exchanging the supporting members 48 and 49 with other supporting members in which the size and disposition of the rib forming portions 53 and 57 differ, it is possible to easily change the size of the ribs RB1 and RB2, the interval in the width direction X or the like without changing the design of the medium supporting portion 27. Furthermore, the size of the rib forming portions 53 and 57 (the ribs RB1 and RB2), for example, refers to the width, which is the length in the width direction X, or to the thickness, which is the length in the vertical direction Z. In other words, at least one of a plurality of supporting members which have different shapes (the size or disposition of the rib forming portions 53 and 57) is used for the supporting members 48 and 49.

However, in the plurality of different supporting members, the difference in thickness of the rib forming portions 53 and 57 is smaller than an adjustment range (in the embodiment, the range of the distance in which the liquid ejecting unit 32 can move in the vertical direction Z) of a relative position of the liquid ejecting unit 32 in relation to the ribs RB1 which is adjusted using the adjustment mechanism 33. Furthermore, when the thickness of the rib forming portions 53 and 57 changes and the height of the ribs RB1 and RB2 becomes higher than the supporting surfaces 48*b* and 49*b*, the adjustment mechanism 33 adjusts the height of the liquid ejecting unit 32. Accordingly, the separation distance between the liquid ejecting unit 32 and the paper S is maintained at an appropriate distance for the ejection of the ink.

Furthermore, when the ribs RB1 and RB2 are formed integrally with the medium supporting portion 27, a great amount of labor and cost is incurred in order to change the shape of the ribs RB1 and RB2. In contrast, since the plate-shaped supporting members 48 and 49 are smaller and more easily manufactured than the medium supporting portion 27, it is possible to mold and change the shape and position of the ribs RB1 and RB2 more easily.

The supporting members 48 and 49 may also be one long member which has a width (the length in the width direction X) equal to that of the medium supporting portion 27. However, by setting the length of the supporting members 48 and 49 in the width direction X to be shorter than that of the medium supporting portion 27, the manufacturing of the supporting members 48 and 49 is simplified. Furthermore, by setting the length of the supporting members 48 and 49 in the width direction X to be short, the manufacturing error thereof is reduced.

Furthermore, the first supporting member 48 is of an axially symmetrical shape in which a straight line which extends in the width direction X is the axis of symmetry AX1. Therefore, if the supporting surfaces 48*b* of the same shape are formed on both surface sides (the upper surface side and the lower surface side) of the first supporting member 48, the ribs RB1 of the same shape and the first suction concave portion 59 are formed even if the first supporting member 48 is inverted over the axis of symmetry AX1 and disposed within the first holding concave portion 41. Accordingly, the work of attaching the first supporting member 48 to the medium supporting portion 27 is easier.

According to the embodiments described above, it is possible to obtain the following effects.

(1) In the medium supporting portion 27, the ribs RB1 and RB2 which support the paper S can be formed by disposing the supporting members 48 and 49, which are configured separately from the medium supporting portion 27 and include the rib forming portions 53 and 57 while being of a simple shape in which the suction pore 45 and the suction pore 47 are included within the holding concave portions 41 and 44, within the holding concave portions 41 and 44 of the medium supporting portion 27. In addition, the supporting members 48 and 49 are configured separately from the medium supporting portion 27 and include the rib forming portions 53 and 57. Accordingly, it is possible to easily form the ribs RB1 and RB2 which are provided on the medium supporting portion 27 which causes the paper S to be adhered thereto.

(2) By disposing two or more of the supporting members 48 and 49 within the holding concave portions 41 and 44 so as to be lined up in the width direction X, it is possible to form a plurality of the ribs RB1 and RB2 within the holding concave portions 41 and 44. In other words, by using a plurality of the supporting members 48 and 49 the length of which are shorter in the width direction X than that of the medium supporting portion 27, it is possible to form a plurality of the ribs RB1 and RB2 more easily.

(3) Since the downstream side connecting portions 55 and 58 connect the end portions of the downstream side in the transport direction of the first rib forming portions 53*a* and 57*a* and the second rib forming portions 53*b* and 57*b*, the transported paper S passes through the downstream side connecting portions 55 and 58. At this time, the catching of the paper S on the downstream side connecting portions 55 and 58 is suppressed due to the paper S being guided along the end portions 55E and 58E of the upstream side in the transport direction of the downstream side connecting portions 55 and 58 which extend in the inclined direction SK2.

(4) It is possible to form the suction concave portions 59 and 60 by accommodating the supporting members 48 and 49 in the holding concave portions 41 and 44. Accordingly, it is possible to easily form the suction concave portions 59 and 60 for sucking the paper S.

(5) It is possible to form three of the ribs RB1 and RB2 lined up in the width direction X and two of the suction concave portions 59 and 60 lined up in the width direction X by accommodating one of the supporting members 48 and 49 in each of the holding concave portions 41 and 44 of the medium supporting portion 27.

(6) Since the supporting members 48 and 49 are plate-shaped members, the manufacturing is simple. In addition, it is possible to form the ribs RB1 even if the first supporting member 48 is disposed within the first holding concave portion 41 in a state of being inverted over the axis of symmetry AX1. Accordingly, it is possible to easily perform the work of disposing the first supporting member 48 within the first holding concave portion 41 of the medium supporting portion 27.

(7) By using other supporting members in which the shape and disposition of the rib forming portions 53 and 57 differ, it is possible to easily change the disposition, the size and the like of the ribs RB1 and RB2 which are formed on the medium supporting portion 27. In addition, even when the size of the rib forming portions 53 and 57 is changed, by adjusting the relative position of the liquid ejecting unit 32 using the adjustment mechanism 33, it is possible to maintain an appropriate separation distance between the paper S which is supported by the ribs RB1 and RB2 and the liquid ejecting unit 32.

Furthermore, the embodiment described above can also be modified as described below.

The medium supporting portion 27 may also be disposed in a state of being inclined such that one end side in the transport direction F of the upper end surface 27*a* is low. Even in this case, the adjustment mechanism 33 adjusts the relative position of the liquid ejecting unit 32 in relation to the ribs RB1.

The positions of the screw holes 48*a* and 49*a* of the supporting members 48 and 49 may also be changed arbitrarily.

The second supporting member 49 may be screwed into the medium supporting portion 27 by three of the screws SC2.

The method of fixing the supporting members 48 and 49 to the medium supporting portion 27 is not limited to screwing. For example, the supporting members 48 and 49 may be adhered to the medium supporting portion 27. The supporting members 48 and 49 may also be engaged with the medium supporting portion 27.

The supporting member may also be a member which includes a suction concave portion. In addition, a suction pore is formed in the bottom portion of the suction concave portion. In this case, it is possible to apply a negative pressure to the inside of the suction concave portion of the supporting member by disposing the suction pores of the supporting member in positions which correspond to the suction pores 45 and 47 of the holding concave portions 41 and 44.

A configuration may also be adopted in which the supporting members 48 and 49 are long supporting members which correspond to the length in the width direction X of the medium supporting portion 27, and one of the supporting members is stored in each of the holding concave portions 41 and 44. In this case, the work of disposing the supporting members 48 and 49 onto the medium supporting portion 27 can be simplified.

The end portions 54E, 55E and 58E of the supporting members 48 and 49 may also be formed so as to extend in the width direction X.

The number of the opening portions 56 and the rib forming portions 53 which are provided in the first supporting member 48 can be arbitrarily changed.

The number of the rib forming portions 57 which are provided in the second supporting member 49 can be arbitrarily changed.

The suction pores 46 and 47, the second holding concave portion 44 and the second supporting member 49 may also be omitted.

A plurality of the holding concave portions 41 and 44 may be provided in the medium supporting portion 27 so as to be lined up in the width direction X, and a different supporting member may be disposed for each of the holding concave portions 41 and 44. For example, different supporting members may be used for the end portions and the inside thereof in the width direction X of the paper S. In this case, it is possible to suppress the occurrence of problems in the transporting of the paper by disposing a supporting member, which includes a downstream side connecting portion of a shape on which the paper S does not easily catch, in a position which corresponds to the end portions in the width direction X of the paper S.

When the lengths in the transport direction F of the first holding concave portion 41 and the second holding concave portion 44 are the same, supporting members of the same shape may be accommodated in the first holding concave portion 41 and the second holding concave portion 44.

The adjustment mechanism 33 may be omitted.

The paper S does not have to be a transfer medium, and may also be cut-sheet paper which is cut to a predetermined length in advance.

The liquid ejecting apparatus is not limited to a serial printer which includes the carriage 31 which moves in the main scanning direction, and may also be a full line head type line printer, in which the liquid ejecting units 32 are provided across the entire width of the width direction X.

In each of the embodiments described above, the liquid ejecting apparatus may also be a liquid ejecting apparatus which ejects or discharges a liquid other than ink. Furthermore, the state of the liquid discharged as minute droplets from the liquid ejecting apparatus includes liquids of a droplet shape, a tear shape and liquid which forms a line shaped tail. In addition, the liquid referred to herein may be a material which can be ejected from a liquid ejecting apparatus. For example, the liquid may be a material which is in a liquid phase state, and includes liquid bodies of high or low viscosity, and fluid bodies such as sol, gel water, other inorganic solvents, organic solvents, solutions, liquid resin, and liquid metal (molten metal). In addition, the liquid not only includes liquids as a state of a material, but also includes solutions, disperses and mixtures in which particles of functional material formed from solids such as pigments and metal particulate are dissolved, dispersed or mixed into a solvent. Representative examples of the liquid include the ink described in the embodiment above or a liquid crystal. Here, the term "ink" includes general aqueous inks and solvent inks, in addition to various liquid compositions such as gel ink and hot melt ink. A specific example of the liquid ejecting apparatus is a liquid ejecting apparatus which ejects a liquid which contains a material such as an electrode material or a color material in the form of a dispersion or a solution. The electrode material or the color may be used in the manufacture and the like of liquid crystal displays, EL (electro-luminescence) displays, surface emission displays and color filters. In addition, the liquid ejecting apparatus may also be a liquid ejecting apparatus which ejects biological organic matter used in the manufacture of bio-chips, a liquid ejecting apparatus which is used as a precision pipette to eject a liquid to be a sample, a textile printing apparatus, a micro dispenser or the like. Furthermore, the liquid ejecting apparatus may also be a liquid ejecting apparatus which ejects lubricant at pinpoint precision into precision machines such as clocks and cameras, or a liquid ejecting apparatus which ejects a transparent resin liquid such as ultraviolet curing resin onto a substrate in order to form minute semispherical lenses (optical lenses) used in optical communication elements and the like. In addition, the liquid ejecting apparatus may also be a liquid ejecting apparatus which ejects an acidic or alkaline etching liquid for etching a substrate or the like.

What is claimed is:

1. A liquid ejecting apparatus, comprising:

a liquid ejecting unit which ejects a liquid onto a medium that is transported in a transport direction;

a suction mechanism for sucking the medium;

a medium supporting portion in which two or more suction pores for applying a suction force of the suction mechanism to the medium are provided so as to be lined up in a width direction; and a supporting member which is configured separately from the medium supporting portion, which includes rib forming portions which form ribs that can support the medium, and which is disposed on the medium supporting portion such that the rib forming portions extend in the transport direction between two of the suction pores which are lined up in the width direction.

2. The liquid ejecting apparatus according to claim 1, wherein the medium supporting portion includes a holding concave portion, wherein the suction pores are provided in an inner bottom portion of the holding concave portion, and wherein the supporting member is disposed within the holding concave portion of the medium supporting portion.

3. The liquid ejecting apparatus according to claim 2, wherein two or more of the supporting members with a length in the width direction which is shorter than that of the medium supporting portion are disposed within the holding concave portion of the medium supporting portion so as to be lined up in the width direction.

4. The liquid ejecting apparatus according to claim 2, wherein the supporting member includes a first rib forming portion and a second rib forming portion which are the rib forming portions that are lined up in the width direction, and a downstream side connecting portion which connects end portions of a downstream side in the transport direction of the first rib forming portion and the second rib forming portion, and wherein an end portion of an upstream side in the transport direction of the downstream side connecting portion extends in an inclined direction which intersects both the transport direction and the width direction.

5. The liquid ejecting apparatus according to claim 2, wherein the supporting member includes two or more of the rib forming portions which are lined up in the width direction and a connecting portion which connects end portions in the transport direction of two of the rib forming portions which neighbor one another in the width direction, where the rib forming portions and the connecting portion form an opening portion, and wherein a suction concave portion for sucking the medium is formed with the opening portion and an inner bottom portion of the holding concave portion due to the supporting member being accommodated within the holding concave portion such that the opening portion surrounds the suction pore.

6. The liquid ejecting apparatus according to claim 5, wherein two or more of the opening portions are provided in the supporting member so as to be lined up in the width direction.

7. The liquid ejecting apparatus according to claim 2, wherein the holding concave portion extends in the width direction, which intersects the transport direction.

8. The liquid ejecting apparatus according to claim 1, wherein the supporting member is a plate-shaped member which includes a supporting surface which is shaped so as to be axially symmetrical, where a straight line which extends in the width direction is an axis of symmetry.

9. The liquid ejecting apparatus according to claim 1, further comprising:

an adjustment mechanism which adjusts a relative position of the liquid ejecting unit in relation to the ribs, wherein at least one of a plurality of the supporting members, which have different sizes of the rib forming portions, is used for the supporting member.

10. The liquid ejecting apparatus according to claim 1, wherein the supporting member is disposed so as to be removable in relation to the medium supporting portion.

* * * * *